US011919696B2

(12) United States Patent
Galbasini et al.

(10) Patent No.: US 11,919,696 B2
(45) Date of Patent: Mar. 5, 2024

(54) SYSTEMS FOR COMPENSATING FOR ATMOSPHERIC PRESSURE CHANGES FOR HIGH-ALTITUDE TRANSPORT OF PACKAGES CONTAINING POWDERED AND/OR GRANULAR MATERIALS

(71) Applicant: Goglio S.p.A., Milan (IT)

(72) Inventors: Roberto Galbasini, Milan (IT); Donato Longhini, Milan (IT)

(73) Assignee: Goglio S.p.A., Milan (IT)

( * ) Notice: Subject to any disclaimer, the term of this patent is extended or adjusted under 35 U.S.C. 154(b) by 168 days.

(21) Appl. No.: 17/761,741

(22) PCT Filed: Sep. 7, 2020

(86) PCT No.: PCT/IB2020/058311
§ 371 (c)(1),
(2) Date: Mar. 18, 2022

(87) PCT Pub. No.: WO2021/053451
PCT Pub. Date: Mar. 25, 2021

(65) Prior Publication Data

US 2022/0340347 A1 Oct. 27, 2022

(30) Foreign Application Priority Data

Sep. 20, 2019 (IT) ..... 102019000016832

(51) Int. Cl.
*B65D 77/22* (2006.01)
*B65D 71/00* (2006.01)
*B65D 77/06* (2006.01)

(52) U.S. Cl.
CPC ..... *B65D 77/225* (2013.01); *B65D 71/0096* (2013.01); *B65D 77/061* (2013.01); *B65D 2571/00012* (2013.01)

(58) Field of Classification Search
CPC ..... B65D 41/0435; B65D 41/0407; B65D 77/225; B65D 77/22; B65D 77/061; B65D 71/0096; B65D 2571/00012
(Continued)

(56) References Cited

U.S. PATENT DOCUMENTS 4,365,715 A 12/1982 Egli
5,992,635 A 11/1999 Walters
(Continued)

FOREIGN PATENT DOCUMENTS

BE 856693 A * 10/1977 ..... B65D 77/225
DE 3044561 A1 8/1981
(Continued)

OTHER PUBLICATIONS

International Search Report and Written Opinion dated Dec. 23, 2020 in corresponding International Application No. PCT/IB2020/058311, 11 pages.

*Primary Examiner* — Robert J Hicks
(74) *Attorney, Agent, or Firm* — MH2 Technology Law Group LLP

(57) ABSTRACT

A system for compensating for atmospheric pressure changes for high-altitude transport of packages containing powdered and/or granular material may include: one or more packages including a one-way degassing valve configured to flow gaseous substances produced by the powdered and/or granular material outside the one or more packages. Each package may include: a casing; and a containment element configured to wrap the casing. The casing may include: a main body made of expandable material; a capping device associated with the main body; and an insertion opening in the main body. The capping device may include: a tubular sleeve including a first coupling and a bottom wall; a closure element including a second coupling; and first and second one-way valves associated with the bottom wall. The first
(Continued)

one-way valve can be configured to allow insertion of gases. The second one-way valve can be configured to allow outflow of gases.

7 Claims, 5 Drawing Sheets

(58) Field of Classification Search
USPC ..... 220/23.83, 23.86, 23.88, 203.04, 203.05, 220/203.06, 203.29, 203.01, 203.19, 202, 220/303, 304, 288; 383/45, 44, 43
See application file for complete search history.

(56) References Cited

U.S. PATENT DOCUMENTS

| | | | |
|---|---|---|---|
| 6,056,439 | A | 5/2000 | Graham |
| 9,771,191 | B2 | 9/2017 | Loaiza Alvarez et al. |
| 2012/0141637 | A1 | 6/2012 | Mooney et al. |
| 2014/0097118 | A1 | 4/2014 | Beer |
| 2019/0031405 | A1 | 1/2019 | Knight et al. |

FOREIGN PATENT DOCUMENTS

| | | | | | |
|---|---|---|---|---|---|
| DE | 4315701 | A1 | | 11/1994 | |
| JP | 07208626 | A | * | 8/1995 | ..... B65D 51/1616 |
| JP | H0958709 | A | | 3/1997 | |
| KR | 20160066506 | A | | 6/2016 | |

* cited by examiner

SYSTEMS FOR COMPENSATING FOR ATMOSPHERIC PRESSURE CHANGES FOR HIGH-ALTITUDE TRANSPORT OF PACKAGES CONTAINING POWDERED AND/OR GRANULAR MATERIALS

CROSS-REFERENCE TO RELATED APPLICATION(S)

This application is a national stage entry from International Application No. PCT/IB2020/058311, filed on Sep. 7, 2020, in the Receiving Office ("RO/IB") of the International Bureau of the World Intellectual Property Organization ("WIPO"), published as International Publication No. WO 2021/053451 A1 on Mar. 25, 2021. International Application No. PCT/IB2020/058311 claims priority under 35 U.S.C. § 119 from Italian Patent Application No. 102019000016832, filed on Sep. 20, 2019, in the Italian Patent and Trademark Office ("IPTO"). The entire contents of all of the above applications and publications are incorporated herein by reference.

TECHNICAL FIELD

The present invention relates to a system for compensating for atmospheric pressure changes usable, for example, for the high-altitude transport of packages containing powdered and/or granular material, in accordance with the preamble of claim 1.

STATE OF THE ART

Packages for the transport of powdered and/or granular materials are known. In particular, such packages comprise an envelope-shaped body and a one-way vent valve associated with such body.

The one-way valve only allows the gaseous substances produced by the material contained in the package to flow outside the package.

At the same time, this one-way valve prevents the entry of gases inside the package. In this way, the one-way valve preserves the freshness and quality of the product contained in the package.

A capping device applicable to a casing is also known in the background art, as shown in US 2019/031405 A1, KR 2016 0066506 A and JP H09 58709 A. In detail, such documents show a capping device comprising a first valve, which allows the insertion of gases into the casing to reach a predetermined pressure value inside the casing, and a second valve, which allows the outflow of gases when the predetermined pressure inside the casing is exceeded.

Problems of the Background Art

Disadvantageously, packages for transporting powdered and/or granular materials are subject to pressure changes of the surrounding environment.

In rest conditions, i.e., with the pressure of the surrounding environment substantially constant and equal to the pressure inside the package, the one-way valve is activated if the material contained inside the package produces gaseous substances.

However, if there is a decrease in the pressure of the surrounding environment with respect to the rest condition, there is an increase in the volume of the package and the corresponding activation of the one-way valve with the outflow of part of the gases initially contained in the package.

The volume of the package is therefore greater than in the rest condition, but with a lower amount of gases.

The increase in the package volume results in a corresponding reduction in the pressure inside the package compared to the rest condition.

If the pressure of the surrounding environment subsequently returns to the rest condition, the so-called vacuum phenomenon is observed. Since the pressure of the surrounding environment is greater than that inside the package and it is not possible to introduce gases inside the package through the one-way valve, the package undergoes considerable compression.

The volume of the package is therefore considerably lower than in the rest condition.

Following pressure changes of the surrounding environment, the package of the prior art is then subjected to corresponding volume variations.

Unfortunately, such variations in volume may compromise the structural integrity of the package with possible aesthetic damage to the package and deterioration of the material contained in the package.

SUMMARY OF THE INVENTION

In this context, the technical task underlying the present invention is to propose a system for compensating for atmospheric pressure changes which overcomes the drawbacks of the prior art.

In particular, an object of the present invention is to propose a system for compensating for atmospheric pressure changes which allows to isolate the interior of a casing of the system from pressure changes in the surrounding environment.

Furthermore, an object of the present invention is to propose a system for compensating for atmospheric pressure changes which allows to reach a pre-set pressure value inside the casing without resorting to the use of a pressure gauge.

The mentioned technical task and the specified objects are substantially achieved by a system for compensating for atmospheric pressure changes comprising the technical features set out in one or more of the appended claims.

Advantages of the Invention

Thanks to an embodiment of the invention, a pre-set pressure value can be achieved inside the casing.

Thanks to the preferred embodiment of the invention it is also possible to keep the package volume inside the casing constant, thereby preserving the structural integrity of the package.

BRIEF DESCRIPTION OF THE DRAWINGS

Further features and advantages of the present invention will become more apparent from the description of an exemplary, but not exclusive, and therefore non-limiting preferred embodiment of a capping device for a casing as illustrated in the appended drawings, in which.

DETAILED DESCRIPTION

Even if not explicitly highlighted, the individual features described with reference to the specific embodiments shall be understood as accessory and/or interchangeable with other features, described with reference to other embodiments.

Figure 3:
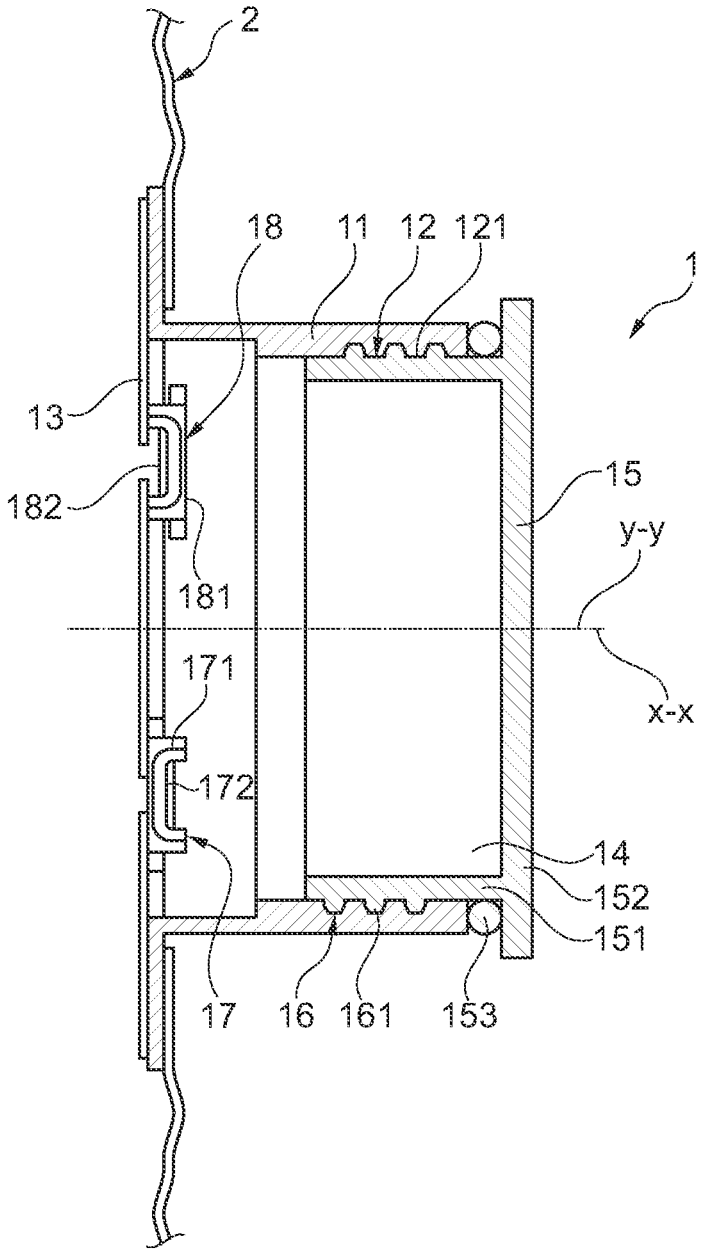
FIG. 3 is a side view of a capping device for a casing, in accordance with the present invention.

With particular reference to FIG. 3, the number 1 indicates a capping device for a casing 2 in accordance with the present invention.

The capping device 1 allows to isolate the interior of the casing 2 from the environment surrounding the casing itself.

This capping device 1 comprises a tubular sleeve 11 extending along an extension axis X-X, a bottom wall 13 configured to close the tubular sleeve 11 below with respect to an opposite upper opening 14 of the closed tubular sleeve 11 and a closure element 15 to close the upper opening 14 of the tubular sleeve 11.

Preferably, such upper opening 14 is opposite the bottom wall 13 along the extension axis X-X.

The sleeve 11 is associated with the casing near the bottom wall 13.

In particular, the sleeve 11 comprises first coupling means 12.

In accordance with the present invention, the capping device 1 comprises a closure element 15 comprising second coupling means 16.

Such second coupling means 16 are reversibly couplable to the first coupling means 12 of the tubular sleeve 11 to seal the upper opening 14 of the tubular sleeve 11.

According to a preferred embodiment, the closure element 15 comprises a closure tubular sleeve 151, which extends along a closure extension axis Y-Y, and a closure wall 152 transverse to the closure extension axis Y-Y.

The second coupling means 16 are positioned at the closure tubular sleeve 151.

In this preferred embodiment, the first coupling means 12 comprise a female thread 121, while the second coupling means 16 comprise a male thread 161.

Preferably, the male thread 161 is reversibly couplable to the female thread 121 such that the closure wall 152 of the closure element 15 covers the upper opening 14 of the tubular sleeve 11. In use, i.e., when the closure element 15 is coupled to the tubular sleeve 11, the closure extension axis Y-Y coincides with the extension axis X-X.

Preferably, the closure element 15 comprises a gasket 153 interposed between the closure wall 152 and the closure tubular sleeve 151. In use, i.e., when the closure element 15 is coupled to the tubular sleeve 11, the gasket 153 is interposed between the closure wall 152 and the tubular sleeve 11. In use, this gasket 153 favours the hermetic closure of the upper opening 14 of the tubular sleeve 11.

In accordance with the present invention, the capping device 1 comprises a first 17 and a second one-way valve 18 associated with the bottom wall 13. Preferably, the first 17 and the second valve 18 are integrated into a thickness of the bottom wall 13.

The first valve 17 allows the insertion of gases inside the casing 2 to reach a pre-set pressure value inside the casing 2. That is, by means of the first valve 17, it is possible to insert pressurized gases inside the casing 2 to reach the pre-set pressure value. That is, again, by means of the first valve 17 it is possible to insert pressurized gases inside the casing 2 so that the pressure difference between the inside and outside of the casing 2 is equal to the pre-set pressure value. Conversely, this first valve 17 does not allow the outflow of gases from the casing 2.

Preferably, said pre-set pressure value is 4-5 mbar.

The second valve 18 allows the outflow of gases outside the casing 2, when the pre-set pressure value inside the casing 2 is exceeded. In other words, when the pressure difference between the inside and outside of the casing 2 exceeds the pre-set pressure value, this second valve 18 allows gases to outflow from the casing 2 until the pressure difference between the inside and outside of the casing 2 is returned to the pre-set pressure value. Conversely, this second valve 18 does not allow the inflow of gases inside the casing 2.

Advantageously, the first 17 and the second valve 18 allow a pre-set pressure value to be reached and maintained inside the casing 2.

Still advantageously, the first 17 and the second valve 18 allow to pressurize the casing 2 to the pre-set pressure value without having to measure the pressure inside the casing 2. In fact, when the difference between the pressure inside and outside the casing 2 exceeds the pre-set pressure value, the second valve 18 is actuated, which allows this difference to be brought back to the pre-set pressure value.

According to a preferred embodiment of the invention, the first valve 17 comprises a valve body 171 and a valve element 172 associated with such valve body 171. This valve element 172 is movable, relative to the valve body 171, between a first operating configuration and a second operating configuration when the pressure outside the casing 2 exceeds the pressure inside the casing 2. In the first operating configuration the entry of gases into the casing 2 is prevented, vice versa in the second operating configuration the entry of gases into the casing 2 is allowed. In the first operating configuration, the outlet of gases to the outside of the casing 2 is also prevented. That is, the valve element 172 is moved to the second operating configuration when the pressurized gases are applied at the tubular sleeve 11, thereby allowing the pressurization of the casing 2. If the pressure inside the casing 2 exceeds the pressure outside the casing 2, the valve element 172 remains blocked in the first operating configuration, not allowing gases to outflow outside the casing 2.

Still in accordance with a preferred embodiment of the invention, the second valve 18 comprises a valve body 181 and a valve element 182 associated with said valve body 181. This valve element 182 is movable, with respect to the valve body 181 of the second valve 18, between a first operating configuration and a second operating configuration upon exceeding the pre-set pressure value inside the casing 2. That is, the valve element 182 is moved to the second operating configuration when the difference between the pressure inside the casing 2 and the pressure outside the casing 2 exceeds the pre-set pressure value. In the first operating configuration the outflow of gases from the casing 2 is prevented, while in the second operating configuration the outflow of gases from the casing 2 is allowed. That is, if the casing 2 is pressurized to a pressure value higher than the pre-set pressure value, the valve element 182 of the second valve 18 is moved into the second operating configuration, allowing gases to outflow until the pressure difference between the inside and outside of the casing is brought back to the pre-set pressure value. Instead, due to pressure differences between the inside and outside of the casing 2 equal to or less than the pre-set pressure value, the valve element 182 of the second valve 18 remains blocked in the first operating configuration, not allowing the outflow of gases outside the casing 2.

Figure 4:
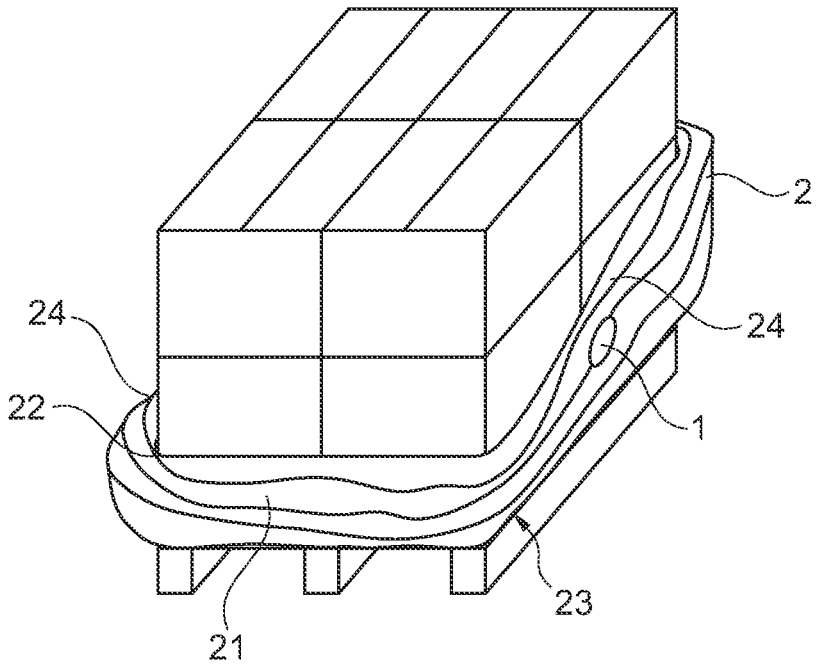
FIG. 4 is a perspective view of the plurality of packages of FIG. 2 in the step of insertion inside a casing according to the present invention.
Figure 5:
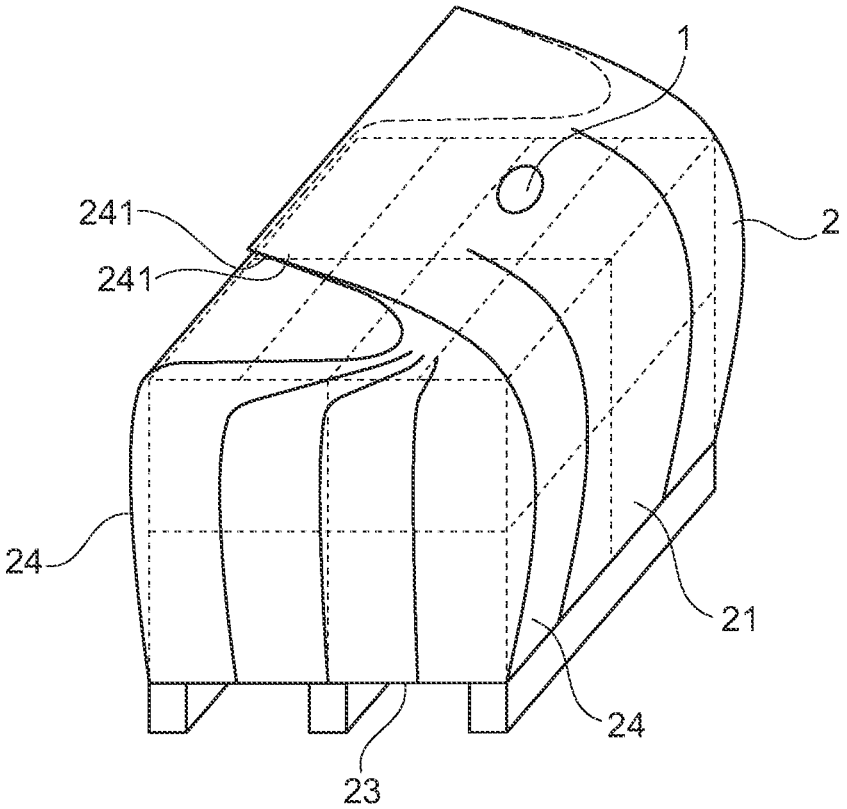
FIG. 5 is a perspective view of the casing of FIG. 4 in a sealed configuration.

A casing 2 is also an object of the present invention (FIGS. 4 and 5). Such casing 2 comprises a main body 21 made of expandable material. Preferably, the expandable material of the main body 21 is a polymeric material.

The casing 2 further comprises the capping device 1 as described above. Such capping device 1 is associated with the main body 21 of the casing 2. Preferably, the bottom wall 13 of the capping device 1 is fixed to the main body 21 of the casing 2. More preferably, the bottom wall 13 is welded to the main body 21 of the casing 2.

In addition, the casing 2 comprises an insertion opening 22 obtained in the main body 21. Such insertion opening 22 is irreversibly resealable to isolate the interior of the main body 21. As will be clearer in a later part of the present invention, packages 3 of powdered and/or granular material may be inserted inside the casing 2 via such insertion opening 22.

Preferably, the main body 21 has an envelope shape.

More preferably, the main body 21 comprises a bottom 23 and a pair of walls 24 connected to the bottom 23. Such walls 24 of the main body 21 define the insertion opening 22.

Preferably, the insertion opening 22 is opposite the bottom 23. That is, the walls 24 of the main body 21 extend from the bottom 23 to a respective upper portion 241. The upper portions 241 of the walls 24 of the main body 21 define the insertion opening 22.

The walls 24 of the main body 21 are weldable together to irreversibly and hermetically close the insertion opening 22, isolating the interior of the main body 21.

Preferably, the walls 24 of the main body 21 are weldable to each other at respective upper portions 241.

Advantageously, by isolating the interior of the main body 21 of the casing 2, it is possible to pressurize this casing 2 through the capping device 1 until the pre-set pressure value is reached.

An object of the present invention is also a system for compensating for atmospheric pressure changes for the high-altitude transport of packages 3 containing powdered and/or granular material, such as ground and/or whole bean coffee.

In fact, as the altitude rises above sea level, there is a progressive decrease in atmospheric pressure compared to the atmospheric pressure at sea level. This change in atmospheric pressure affects the packages 3 transported at high altitudes.

Figure 1:
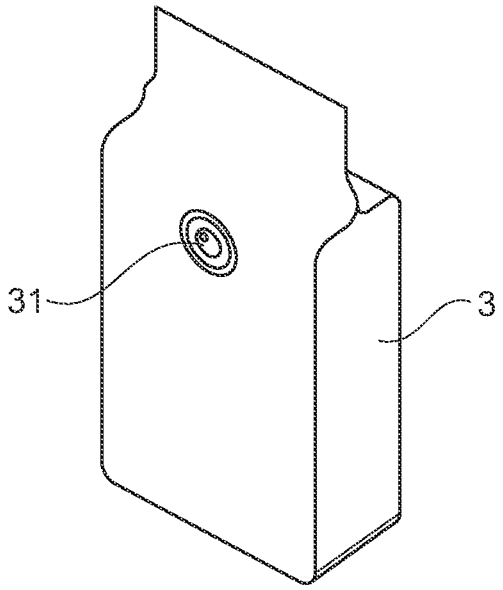
FIG. 1 is a perspective view of a package containing powdered and/or granular products according to the state of the art.
Figure 2:
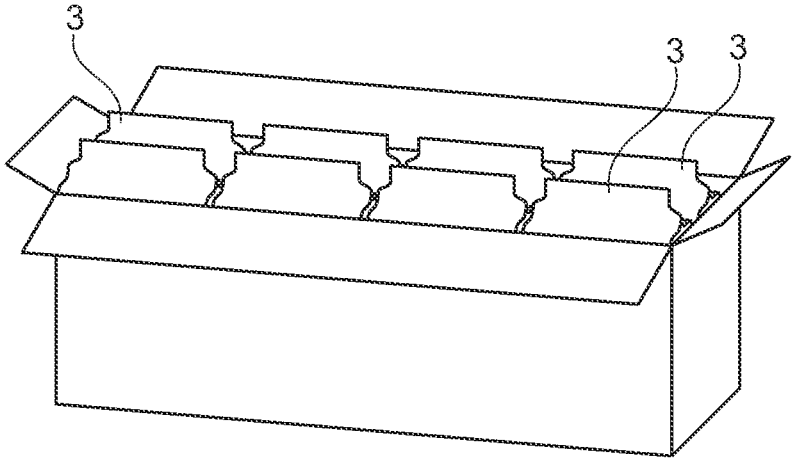
FIG. 2 is a perspective view of a plurality of packages of FIG. 1 inserted into a container according to the state of the art.

The system comprises one or more packages 3 (FIG. 1). Each package 3 comprises a one-way degassing valve 31 configured to flow the gaseous substances produced by the material contained in the package 3 outside the package 3. At the same time, this degassing valve 31 prevents the entry of gases inside the package 3. In other words, the degassing valve 31 is activated when the pressure inside the package 3 exceeds the pressure outside the package 3, allowing the gaseous substances to flow outside. This degassing valve 31 thus allows the quality of the material contained inside the package 3 to be preserved.

The package 3 provided with the one-way degassing valve 31 is known in the state of the art and will therefore not be further described.

In addition, the system comprises the casing 2 as described above.

The packages 3 are insertable into the casing 2 via the insertion opening 22 of the main body 21 of the casing 2.

As will be clearer in a later part of the present description, the packages 3 can be isolated from changes in the surrounding atmospheric pressure.

Figure 6:
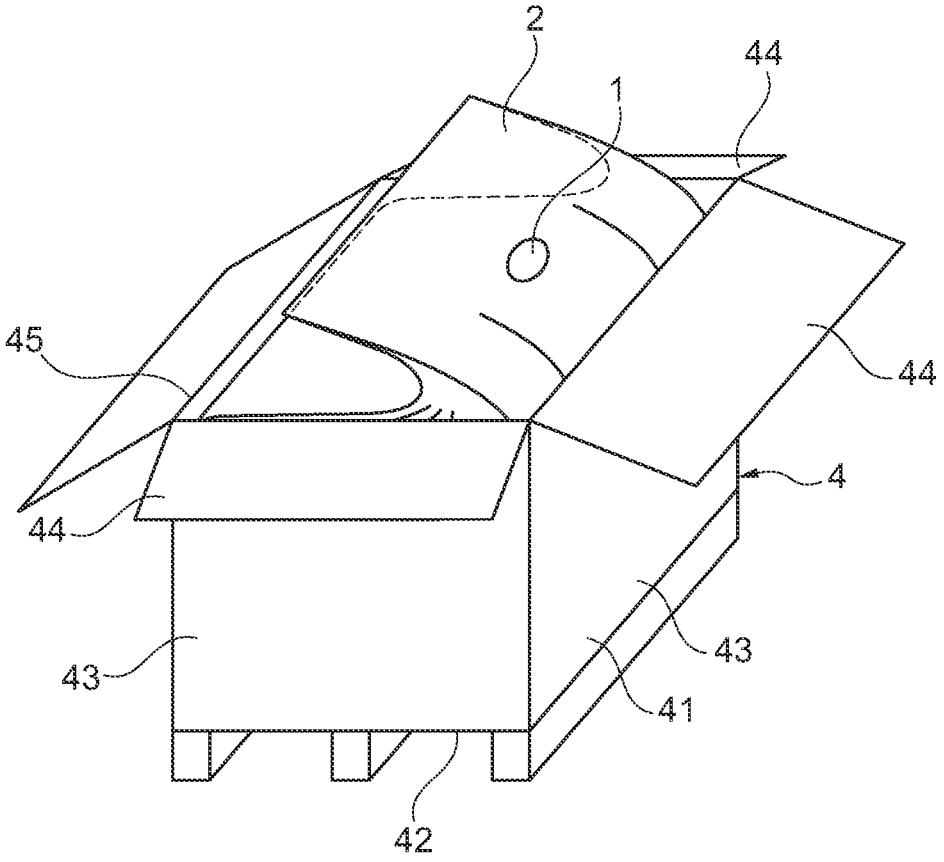
FIG. 6 is a perspective view of the casing of FIG. 5 in the step of insertion inside a container.
Figure 7:
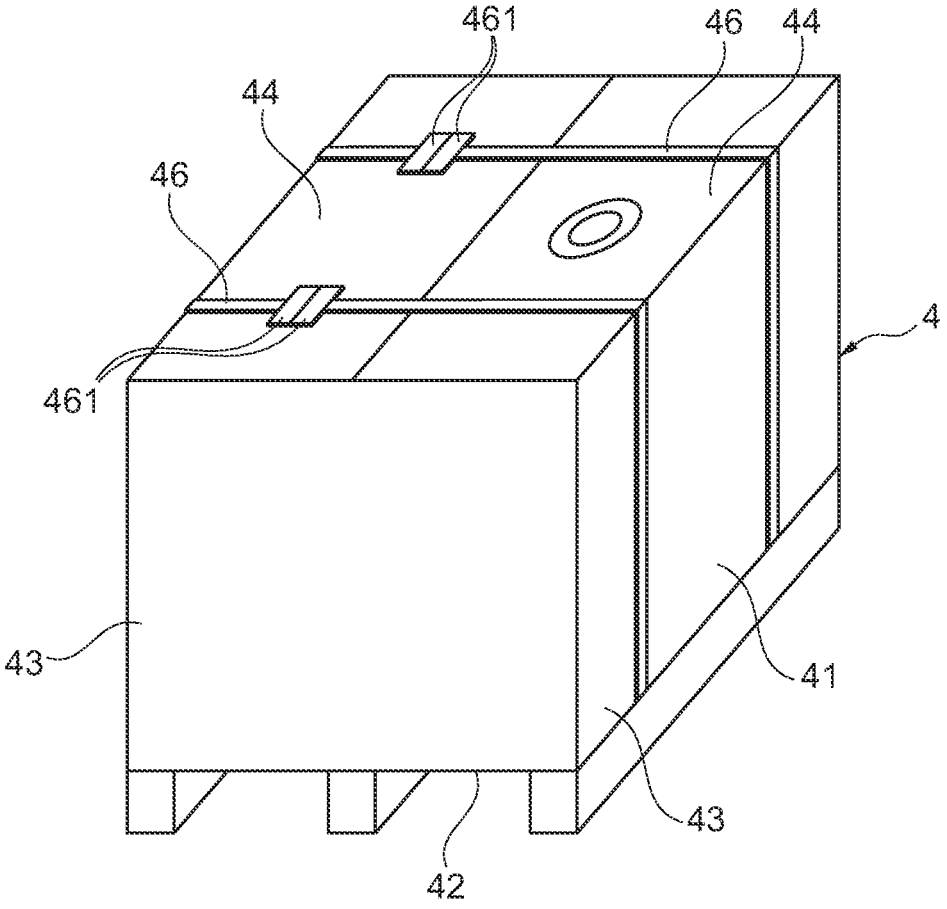
FIG. 7 is a perspective view of the container of FIG. 6 in a closed configuration.

Finally, the system comprises a containment element 4 configured to wrap the casing 2 (FIG. 6).

As will be clearer in a later part of the present description, this containment element 4 is configured to counteract the excessive expansion of the casing 2 which can occur at high altitudes, i.e., at low atmospheric pressure values.

According to a preferred embodiment, the containment element 4 comprises a container 41. Such a container 41 comprises a bottom 42 and a plurality of walls 43 connected to the bottom 42 of the container 41 and ending with folding flaps 44.

Preferably, the container 41 has a parallelepiped shape.

The walls 43 of the container 41 define an access opening 45 inside the container 41.

The casing 2 is insertable inside the container 41 via the access opening 45. This access opening 45 can be closed by overlapping the folding flaps 44 of the walls 43 of the container 41.

Preferably, the containment element 4 comprises a plurality of belts 46.

More preferably, the containment element 4 comprises a pair of belts 46.

Each belt 46 can be overlapped outside the container 41 to overlap the plurality of folding flaps 44 of the walls 43 of the container 41.

Each belt 46 comprises a pair of opposite ends 461 along an extension direction of the belt 46.

Each belt 46 is overlapped outside the container 41 so as to fix opposite ends 461 to each other.

It should be noted that the belts 46 help the container 41 counteract the excessive expansion of the casing 2.

In accordance with an alternative embodiment to the preceding one, the containment element 4 comprises a containment net (not illustrated in the attached figures). This containment net is configured to wrap the casing 2 to counteract the excessive expansion thereof.

Finally, an object of the present invention is a method for the high-altitude transport of packages 3 containing powdered and/or granular material using the casing 2 described above.

In the following description, high-altitude transport refers to the transport of packages 3 from a first area at a low altitude to a second area at a higher altitude. The second area, i.e., the area with the higher altitude, is characterized by a lower atmospheric pressure level with respect to the first area.

The method comprises the step of inserting the plurality of packages 3 inside the main body 21 of the casing 2 through the insertion opening 22 of the casing 2.

Next, the method comprises the step of welding the walls 24 of the main body 21 of the casing 2 in order to close the insertion opening 22 of the main body 21. Preferably, the method comprises welding the walls 24 together at the respective upper portions 241.

The method thus comprises the step of pressurizing the casing 2 by inserting gases through the first valve 17 of the capping device 1 until the pre-set pressure value is reached. That is, in accordance with the above, the method comprises the step of pressurizing the casing 2 by inserting gases through the first valve 17 until the actuation of the second valve 18. In fact, the second valve 18 is actuated when the difference between the pressure inside and outside the casing 2 exceeds the pre-set pressure value. Such a second valve 18 allows gases to outflow from the casing 2 until this pressure difference is brought back to the pre-set pressure value.

The method further comprises the step of coupling the second coupling means 16 of the closure element 15 with the first coupling means 12 of the tubular sleeve 11 in order to hermetically close the upper opening 14 of the tubular sleeve 11. It should be noted that, by hermetically closing the upper opening 14 of the tubular sleeve 11, the operation of the first 17 and the second valve 18 of the capping device 1 is precluded. In fact, the first 17 and the second valve 18 are not subject to changes in atmospheric pressure, i.e., to changes in pressure outside the casing 2. That is, thanks to the closure element 15, the first 17 and the second valve 18 are both maintained in the first operating configuration. That is, again, thanks to the closure element 15 the first valve 17 does not allow the insertion of gases inside the casing 2, while the second valve 18 does not allow the outflow of gases from the casing 2.

The steps of the method just described are to be understood as preparatory steps for the transport of the packages 3 at heights. That is, such steps of the method are carried out at the first area, i.e., the lower altitude area.

At this first area, i.e., in initial conditions, the difference between the pressure inside and outside the casing 2 is maintained equal to the pre-set value. Still in the initial conditions, the pressure inside the casing 2 remains higher than the pressure inside the packages 3, not allowing the degassing valves 31 to be actuated.

In accordance with what was previously introduced, in the case of transport of the casing 2 from the first to the second area, there is a reduction in atmospheric pressure. This reduction in atmospheric pressure results in an increase in the volume of the casing 2. However, since the second valve 18 is blocked by the presence of the closure element 15, this increase in volume is not accompanied by an outflow of gases from the casing 2. At the second area, there is therefore an increase in the volume of the casing 2, but with the same amount of gases as the initial conditions. The increase in the volume of the casing 2 is accompanied by a reduction of the pressure inside the casing 2 with respect to the pre-set pressure value. However, this pressure inside the casing 2 remains higher than the pressure inside the packages 3, not allowing the degassing valves 31 to be actuated. Consequently, the content of gases inside the package 3 remains equal to the content of the initial conditions.

If the casing 2 is subsequently transported from the second area to the first area, i.e., in the case of a return to the initial atmospheric pressure conditions, the increase in atmospheric pressure results in the return of the volume of the casing 2 to the initial condition, since the quantity of gases contained therein has remained unchanged. Advantageously, the packages 3 also retained the initial volume, since during high-altitude transport the degassing valve 31 did not allow gases to outflow from the package 3.

According to a preferred embodiment of the method for high-altitude transport, this method provides for the use of the containment element 4 described above.

The method thus comprises the step of wrapping the casing 2 in the containment element 4. This containment element 4 is configured to counteract the excessive expansion of the casing 2. In fact, in accordance with what has been described above, following the reduction of atmospheric pressure there is an increase in the volume of the casing 2. If not adequately counteracted, this increase in volume can lead to the breakage of the casing 2.

Preferably, this step of wrapping the casing 2 in the containment element 4 comprises the sub-step of inserting the casing 2 inside the container 41 through the access opening 45 of the container 41. Preferably, such container 41 is made of a rigid material.

Subsequently, the step of wrapping the casing 2 in the containment element 4 comprises the sub-step of closing the access opening 45 of the container 41 by overlapping the folding flaps 44 of the walls 43 of the container 41.

In order to increase the resistance of the container 41 to the expansion of the casing 2, the step of wrapping the casing 2 in the containment element 4 comprises the sub-step of overlapping the folding flaps 44 of the walls 43 of the container 41 by the pair of belts 46. The belts 46 act as a further force counteracting the expansion of the casing 2.

Clearly, in order to satisfy contingent and specific needs, a person skilled in the art may make numerous modifications and variants to the configurations described above. Such modifications and variations are all also contained within the scope of the invention, as defined by the following claims.

The invention claimed is:

1. A system for compensating for atmospheric pressure changes for high-altitude transport of packages containing powdered and/or granular material, the system comprising:

one or more packages comprising a one-way degassing valve configured to flow gaseous substances produced by the powdered and/or granular material contained in the one or more packages outside the one or more packages;

wherein each of the one or more packages comprises:

a casing; and a containment element configured to wrap the casing;

wherein the casing comprises:

a main body made of expandable material;

a capping device associated with the main body; and an insertion opening obtained in the main body, wherein the insertion opening is irreversibly resealable to isolate an interior of the main body, wherein the one or more packages are insertable in the casing through the insertion opening of the main body;

wherein the capping device comprises:

a tubular sleeve extending along an extension axis associated with the casing to close the casing, the tubular sleeve comprising first coupling means and a bottom wall configured to close the tubular sleeve below with respect to an opposite upper opening of the tubular sleeve;

a closure element comprising second coupling means, wherein the second coupling means is configured to reversibly couple to the first coupling means of the tubular sleeve to hermetically close the upper opening of the tubular sleeve; and a first one-way valve and a second one-way valve associated with the bottom wall;

wherein the first one-way valve is configured to allow insertion of gases inside the casing to reach a pre-set pressure value inside the casing, and wherein the second one-way valve is configured to allow outflow of gases outside the casing, upon exceeding the pre-set pressure value inside the casing.

2. The system of claim 1, wherein the first one-way valve comprises:

a valve body; and a valve element associated with the valve body;

wherein the valve element of the first one-way valve is configured to move between a first operating configuration, wherein entry of gases into the casing is prevented, and a second operating configuration, wherein the entry of gases into the casing is allowed when pressure outside the casing exceeds pressure inside the casing.

3. The system of claim 1, wherein the second one-way valve comprises:

a valve body; and a valve element associated with the valve body;

wherein the valve element of the second one-way valve is configured to move between a first operating configuration, wherein outflow of gases from the casing is prevented, and a second operating configuration, wherein the outflow of gases from the casing is allowed upon exceeding the pre-set pressure value inside the casing.

4. The system of claim 1, wherein the main body comprises:

a bottom; and a pair of walls connected to the bottom;

wherein the walls of the main body define the insertion opening, and wherein the walls of the main body are weldable to each other to irreversibly and hermetically close the insertion opening to isolate the interior of the main body.

5. The system of claim 1, wherein the expandable material of the main body is a polymeric material.

6. The system of claim 1, wherein the containment element comprises a container, wherein the container comprises:

a bottom; and a plurality of walls connected to the bottom and ending with folding flaps;

wherein the walls of the container define an access opening inside the container, wherein the casing is insertable inside the container via the access opening, and wherein the access opening is resealable by overlapping the folding flaps of the walls of the container.

7. The system of claim 6, wherein the containment element further comprises a plurality of belts, and wherein each belt of the plurality of belts is configured to overlap outside the container to overlap the folding flaps of the walls of the container.

* * * * *